US009734970B1

(12) United States Patent
Choi

(10) Patent No.: US 9,734,970 B1
(45) Date of Patent: Aug. 15, 2017

(54) AUXILIARY RELAY OF ELECTRONIC CONTACTOR

(71) Applicant: LSIS CO., LTD., Gyeonggi-do (KR)

(72) Inventor: Koanho Choi, Gyeonggi-do (KR)

(73) Assignee: LSIS CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/226,847

(22) Filed: Aug. 2, 2016

(30) Foreign Application Priority Data

Feb. 15, 2016 (KR) ..... 10-2016-0017462

(51) Int. Cl.
*H01H 36/00* (2006.01)
*H01H 45/04* (2006.01)

(52) U.S. Cl.
CPC ..... *H01H 45/04* (2013.01); *H01H 36/006* (2013.01); *H01H 36/0006* (2013.01); *H01H 36/0013* (2013.01); *H01H 36/0033* (2013.01); *H01H 2239/034* (2013.01)

(58) Field of Classification Search
CPC ..... H01H 36/0006; H01H 36/0013; H01H 36/0033; H01H 36/006; H01H 36/0066
See application file for complete search history.

(56) References Cited

FOREIGN PATENT DOCUMENTS

| | | | |
|---|---|---|---|
| JP | 59-194252 U | * | 12/1984 |
| JP | 2006253068 | | 9/2006 |
| JP | 2012014988 | | 1/2012 |
| JP | 2013020906 | | 1/2013 |
| JP | 2013225391 | | 10/2013 |
| JP | 5433428 | | 3/2014 |
| JP | 5521843 | | 6/2014 |
| KR | 1019990065899 | | 8/1999 |

OTHER PUBLICATIONS

Search Report from Korean Application No. 02-6915-6400 dated Oct. 8, 2015 in 5 pages.
Office Action for Korean Application No. 10-2016-0017462 issued on Jan. 18, 2017, in 5 pages.

* cited by examiner

*Primary Examiner* — Ramon M Barrera
(74) *Attorney, Agent, or Firm* — Knobbe, Martens, Olson & Bear, LLP

(57) ABSTRACT

Disclosed embodiments relate to an auxiliary relay of an electronic contactor. In some embodiments, an auxiliary relay has its conducting state controlled by a plurality of lead switches, in a non-exposed state of contact parts to the outside. This may prevent dust or foreign materials from clinging to the contact parts.

6 Claims, 10 Drawing Sheets

AUXILIARY RELAY OF ELECTRONIC CONTACTOR

CROSS-REFERENCE TO RELATED APPLICATIONS

This application claims the benefit of Korean Application No. 10-2016-0017462, filed on Feb. 15, 2016, which is hereby incorporated by reference in its entirety.

BACKGROUND

Technical Field

The present disclosure relates to an auxiliary relay of an electronic contactor, and more particularly, to an auxiliary relay of an electronic contactor capable of enhancing a conducting performance by preventing exposure of contact parts to the outside.

Description of the Related Art

Generally, an electronic contactor means an apparatus capable of opening or closing a load on a power transmission/distribution system or an electric circuit, or capable of interrupting a current when an accident such as a ground fault or a short circuit, occurs.

Such an electronic contactor is provided with an auxiliary relay on an upper surface or a side surface thereof, so as to assist an operation of a main contact. Referring to FIG. 1, the auxiliary relay is provided on an upper surface of the electronic contactor.

As shown in FIG. 1, in the conventional auxiliary relay of the electronic contactor, an auxiliary fixed contact 11 is provided at a frame 10, and an auxiliary movable contact 13 is integrally formed at a movable member 12. The movable member 12 is connected to a cross bar (not shown) of the electronic contactor, and moves up and down by interworking with an up-down motion of the cross bar.

In a case where the electronic contactor has a configuration of a contact circuit 'a' (normal 'open') and a contact circuit 'b' (normal 'close'), a coil (not shown) of a main contact of the electronic contactor is magnetized, and thus a fixed core (not shown) is magnetized. As a result, a movable core (not shown) moves, and thus the cross bar having the movable core moves. In this case, the movable member 12 connected to the cross bar also moves. As a result, the contact circuit 'a' is in a conducted state and the contact circuit 'b' is in an interrupted state, by the auxiliary fixed contact 11 and the auxiliary movable contact 13 of the auxiliary relay.

On the contrary, if the coil is demagnetized, the movable member 12 moves as the cross bar moves. As a result, the contact circuit 'a' is in an interrupted state and the contact circuit 'b' is in a conducted state.

However, the conventional auxiliary relay of the electronic contactor may have the following problems.

Firstly, since the auxiliary fixed contact 11 and the auxiliary movable contact 13 are exposed to the outside, dust or foreign materials may be easily attached to the contacts.

Further, since dust or foreign materials are easily attached to the contacts, a conducting performance of the auxiliary relay may be greatly lowered.

SUMMARY

Therefore, an aspect of the detailed description is to provide an auxiliary relay of an electronic contactor capable of enhancing a conducting performance by preventing exposure of contact parts to the outside.

To achieve these and other advantages and in accordance with the disclosed embodiments, there is provided an auxiliary relay of an electronic contactor, including: a frame including each component; a movable member configured to move in the frame, and including a magnet member at one side thereof; a conducting member disposed in the frame, and including a first switch unit and a second switch unit which are conducted as the magnet member moves; a first terminal connected to the first switch unit, and configured to apply a current according to whether the first switch unit has been conducted or not; and a second terminal connected to the second switch unit, and configured to apply a current according to whether the second switch unit has been conducted or not.

The first switch unit and the second switch unit may be lead switches.

The conducting member may be formed as a printed circuit board (PCB).

The first terminal and the second terminal may be formed to be inclined with a predetermined angle.

A magnet member inserting unit configured to fixedly-insert the magnet member thereinto may be provided on a side surface of the movable member.

The magnet member inserting unit may be formed such that front and rear surfaces thereof are open.

A guide rail (or a plurality of guide rails) disposed at two sides of the frame and configured to fit the conducting member thereinto, and a hook part may be formed in the frame, the hook part contacting one surface of the conducting member.

Some embodiments of the present disclosure may include the following advantages.

Firstly, the auxiliary relay of an electronic contactor has its conducted state controlled by the plurality of lead switches, in a non-exposed state of the contact parts to the outside. This may prevent dust or foreign materials from clinging to the contact parts.

Further, since the contact parts are not exposed to the outside, an oxidized film may not be formed. This may prevent lowering of a conducting performance.

Further, since dust or foreign materials are prevented from clinging to the contact parts, lowering of a conducting performance of the auxiliary relay may be prevented.

Further scope of applicability of the present application will become more apparent from the detailed description given hereinafter. However, it should be understood that the detailed description and specific examples, while indicating embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate embodiments and together with the description serve to explain the principles of the disclosure.

DETAILED DESCRIPTION

Description will now be given in detail of configurations of an auxiliary relay of an electronic contactor according to the present disclosure, with reference to the accompanying drawings.

Figure 1:
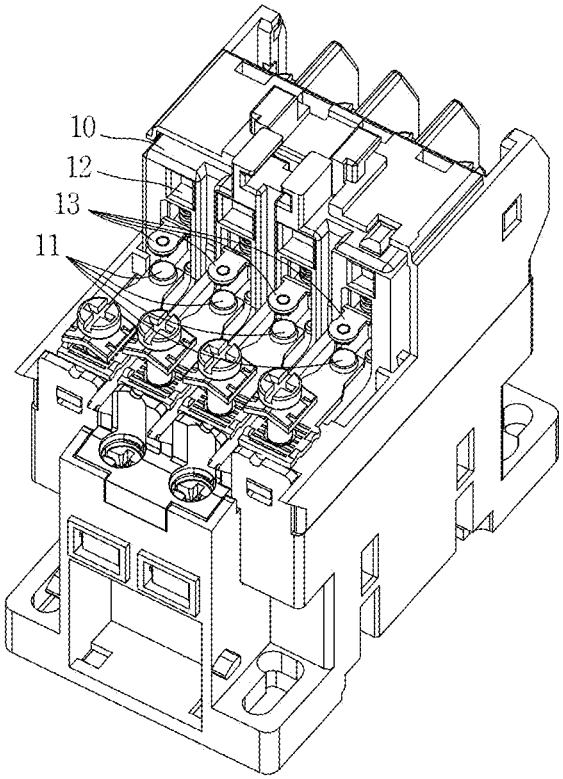
FIG. 1 RELATED ART
FIG. 1 is a perspective view of an electronic contactor according to the prior art.
Figure 2:
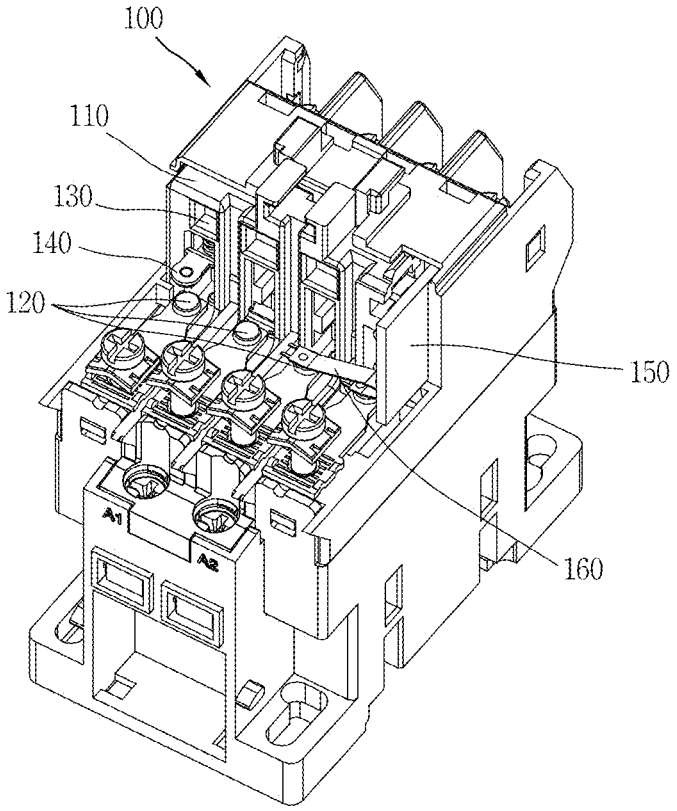
FIG. 2 is a perspective view of an electronic contactor including an auxiliary relay according to some embodiments of the present disclosure.
Figure 3A:
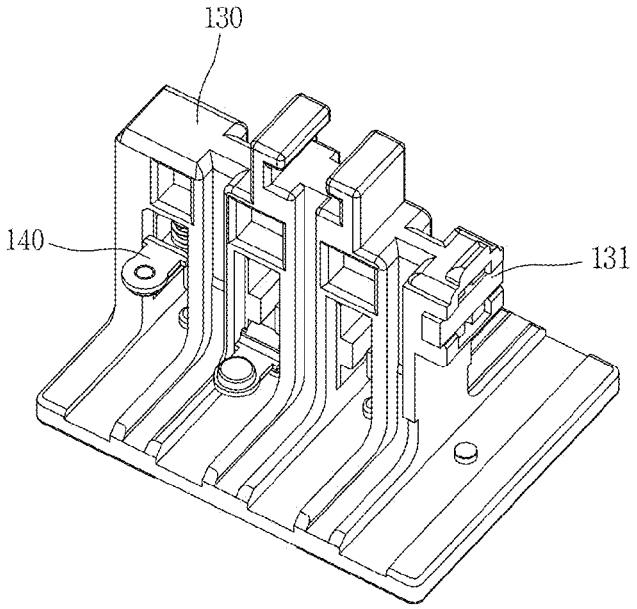
FIG. 3A is a perspective view illustrating a state where a magnet member is provided at a movable member of an auxiliary relay according to some embodiments of the present disclosure.
Figure 3B:
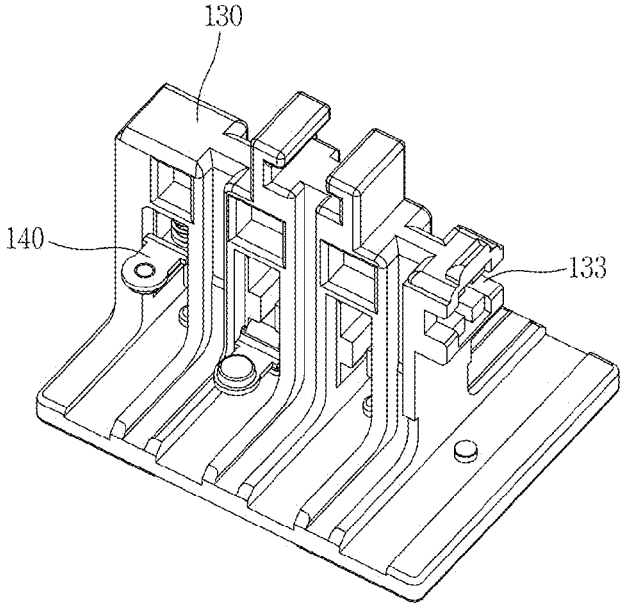
FIG. 3B is a perspective view illustrating a state where the magnet member is separated from the movable member of the auxiliary relay according to some embodiments of the present disclosure.
Figure 4:
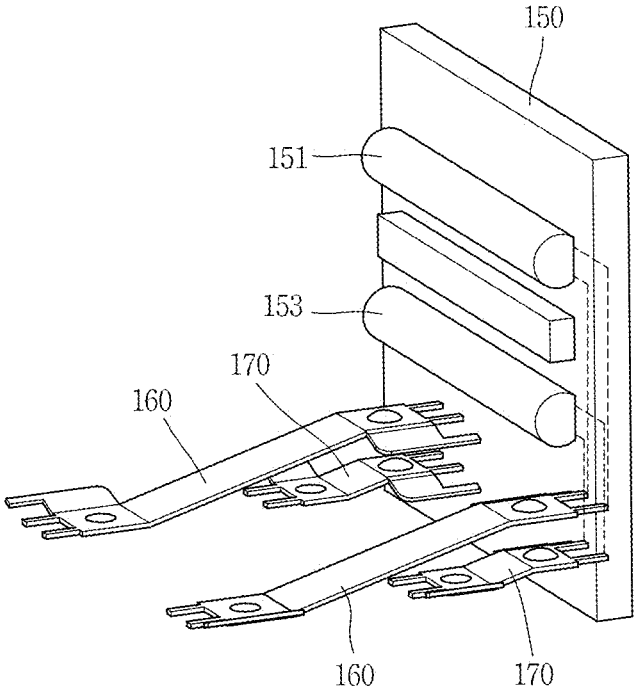
FIG. 4 is a perspective view illustrating a conducting member of the auxiliary relay according to some embodiments of the present disclosure.
Figure 5:
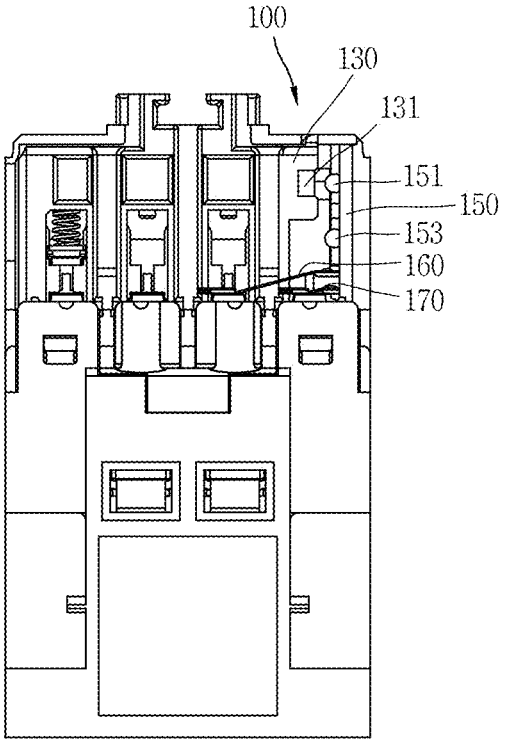
FIG. 5 is a frontal view illustrating a position of the conducting member in an 'OFF' state of a main contact of an electronic contactor according to some embodiments of the present disclosure.
Figure 6:
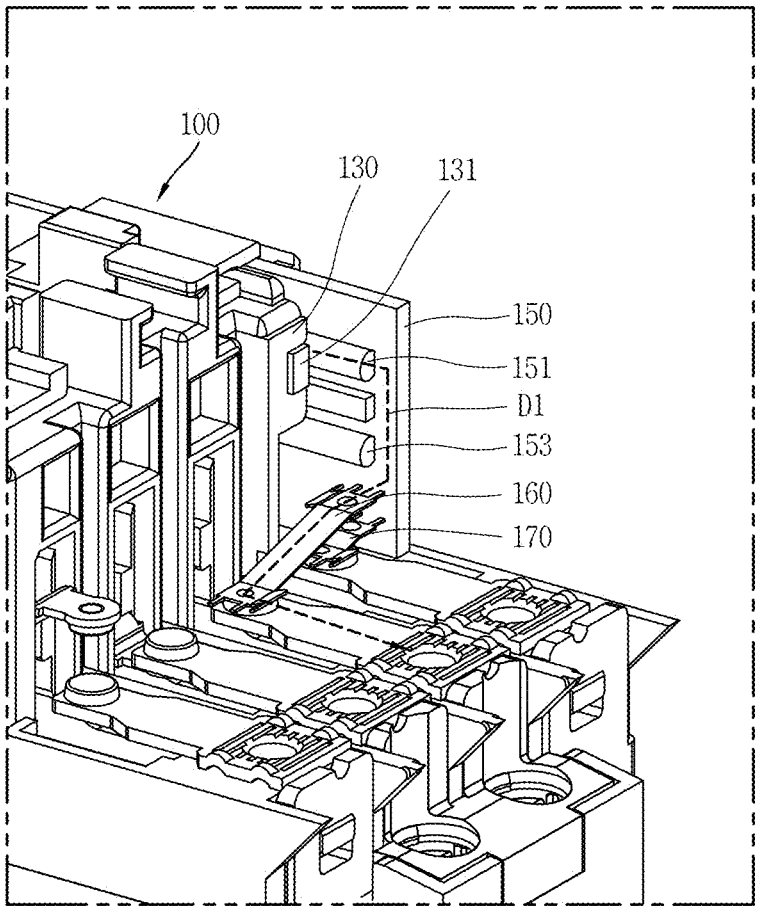
FIG. 6 is a perspective view illustrating a position of the conducting member in an 'OFF' state of the main contact of the electronic contactor according to some embodiments of the present disclosure.
Figure 7:
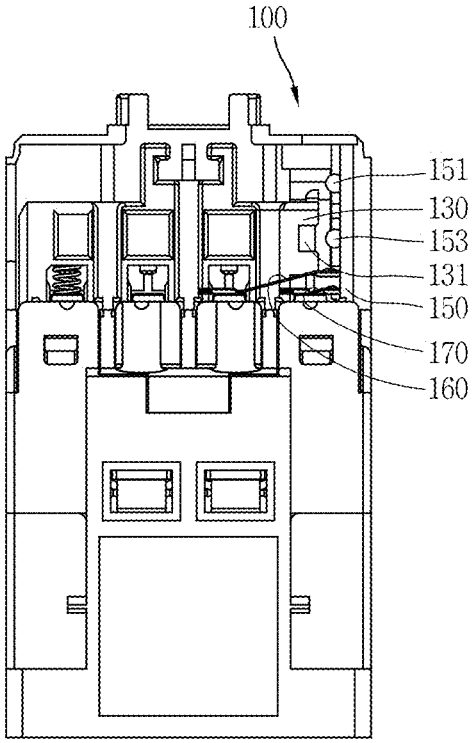
FIG. 7 is a frontal view illustrating a position of the conducting member in an 'ON' state of the main contact of the electronic contactor according to some embodiments of the present disclosure.
Figure 8:
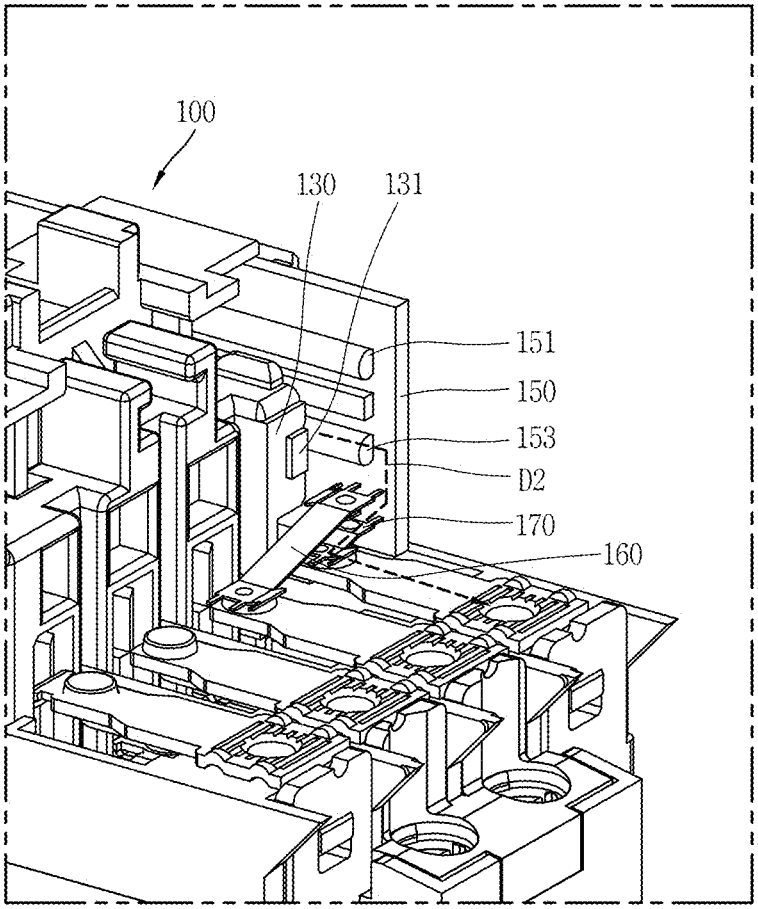
FIG. 8 is a perspective view illustrating a position of the conducting member in an 'ON' state of the main contact of the electronic contactor according to some embodiments of the present disclosure.
Figure 9:
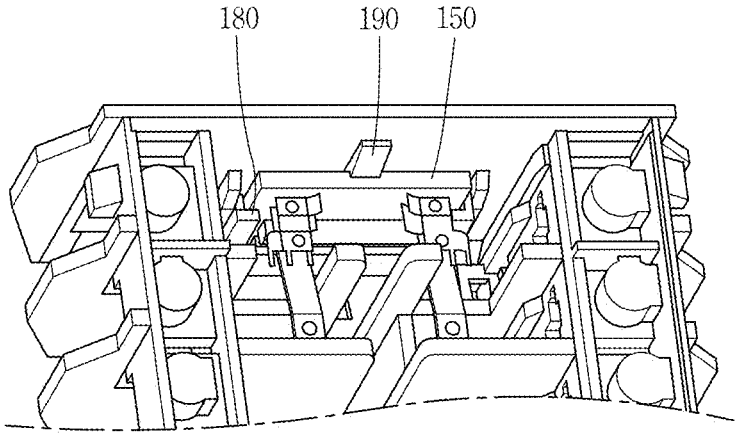
FIG. 9 is a perspective view illustrating an inserted state of the conducting member of the electronic contactor into the auxiliary relay according to some embodiments of the present disclosure.

FIG. 2 is a perspective view of an electronic contactor including an auxiliary relay according to some embodiments of the present disclosure. FIG. 3A is a perspective view illustrating a state where a magnet member is provided at a movable member of the auxiliary relay according to some embodiments of the present disclosure. FIG. 3B is a perspective view illustrating a state where the magnet member is separated from the movable member of the auxiliary relay according to some embodiments of the present disclosure. FIG. 4 is a perspective view illustrating a conducting member of the auxiliary relay according to some embodiments of the present disclosure. FIG. 5 is a frontal view illustrating a position of the conducting member in an 'OFF' state of a main contact of an electronic contactor according to some embodiments of the present disclosure. FIG. 6 is a perspective view illustrating a position of the conducting member in an 'OFF' state of the main contact of the electronic contactor according to some embodiments of the present disclosure. FIG. 7 is a frontal view illustrating a position of the conducting member in an 'ON' state of the main contact of the electronic contactor according to some embodiments of the present disclosure. FIG. 8 is a perspective view illustrating a position of the conducting member in an 'ON' state of the main contact of the electronic contactor according to some embodiments of the present disclosure. And FIG. 9 is a perspective view illustrating an inserted state of the conducting member of the electronic contactor into the auxiliary relay according to some embodiments of the present disclosure.

As shown in FIGS. 2 to 4, the auxiliary relay 100 according to some embodiments of the present disclosure includes a frame 110 including each component, a movable member 130 which moves in the frame 110 up and down, a conducting member 150 fitted (inserted) into the frame 110, and a first terminal 160 and a second terminal 170 connected to the conducting member 150.

The frame 110 forms the appearance of the auxiliary relay 100, and is provided with each component of the auxiliary relay 100.

The movable member 130 is provided in the frame 110, and is connected to a cross bar (not shown) of the main contact of the electronic contactor. As the cross bar moves, the movable member 130 moves up and down.

In this case, the movable member 130 is provided with an auxiliary movable contact 140, and a magnet member 131 is provided on a side surface of the movable member 130. As the movable member 130 moves, the magnet member 131 moves to control a current supply by controlling a conducted state of the conducting member 150.

A magnet member inserting unit 133 configured to fixedly-insert the magnet member 131 thereinto is provided on a side surface of the movable member 130. The magnet member 131 is fitted into the side surface of the movable member 130 through the magnet member inserting unit 133. In this case, since front and rear surfaces of the magnet member inserting unit 133 are open, the magnet member 131 may be easily mounted to or separated from the magnet member inserting unit 133, even if the magnet member 131 includes a greater length than the magnet member inserting unit 133.

The conducting member 150 is fitted into a side surface of the frame 110, and a conducted state thereof is controlled by the magnet member 131 which moves as the movable member 130 moves.

The conducting member 150 is configured as a printed circuit board (PCB), etc., and is provided with each circuit component. The conducting member 150 is provided with a first lead switch 151 and a second lead switch 153, such that a conducted state thereof is controlled as the magnet member 131 moves by movement of the movable member 130.

As shown in FIG. 9, the conducting member 150 is stably fitted into the frame 110 in a fixed manner. More specifically, a guide rail 180 and a hook part 190 are formed at the frame 110, and two sides of the conducting member 150 are fitted into the guide rail 180. And one surface of the conducting member 150 is disposed to contact one surface of the hook part 190.

The first lead switch 151 is a vacuum tube-type switch turned on or off by a magnetic force.

Figure 10:
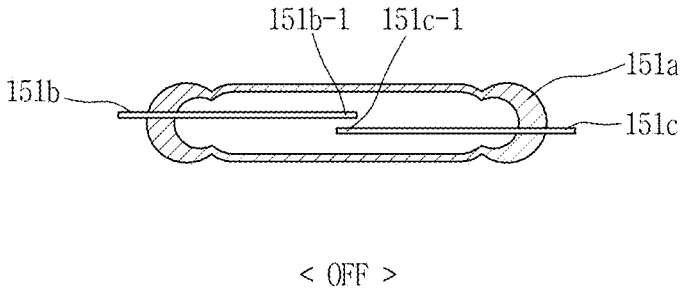
FIG. 10 is a schematic view illustrating an 'OFF' state of a lead switch of the auxiliary relay according to some embodiments of the present disclosure.
Figure 11:
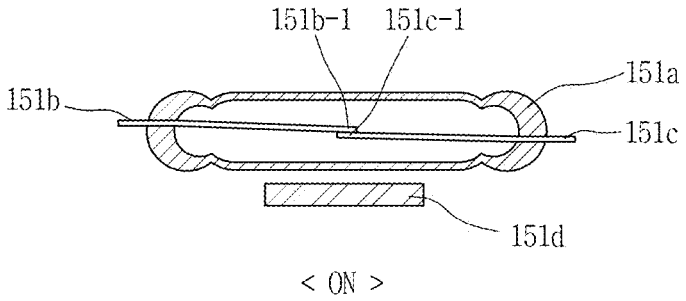
FIG. 11 is a schematic view illustrating an 'ON' state of the lead switch of the auxiliary relay according to some embodiments of the present disclosure.

That is, as shown in FIGS. 10 and 11, the first lead switch 151 is configured such that contact parts **151*b*-1, 151*c*-1 of magnetic substance leads 151*b*, 151*c* are positioned in a glass tube 151*a* comprising inactivate gas therein. If a permanent magnet 151*d* is positioned near the contact parts in an 'OFF' state where the contact parts 151*b*-1, 151*c*-1 of the magnetic substance leads 151*b*, 151*c* are separated from each other, the contact parts 151*b*-1, 151*c*-1 of the magnetic substance leads 151*b*, 151*c*** contact each other by an external magnetic field for an 'ON' state.

Accordingly, the first lead switch 151 of the conducting member 150 is positioned near the magnet member 131, and is connected to the first terminal 160 so as to be conductable such that a conducted state of the conducting member 150 is controlled by the magnet member 131.

The first terminal 160 is connected to an auxiliary fixed contact 120 of the frame 110 so as to include a predetermined inclination angle. Accordingly, if the first lead switch 151 is turned on by the magnet member 131, current which has passed through the auxiliary fixed contact 120 and the first terminal 160 is applied to the outside via the first lead switch 151.

The second lead switch 153 is a vacuum tube type switch turned on or off by a magnetic force, and includes the same configuration as the first lead switch 151. The second lead switch 153 of the conducting member 150 is positioned near the magnet member 131, and is connected to the second terminal 170 so as to be conductable such that a conducted state of the conducting member 150 is controlled by the magnet member 131.

The second terminal 170 is connected to the auxiliary fixed contact 120 of the frame 110 so as to include a predetermined inclination angle. Accordingly, if the second lead switch 153 is turned on by the magnet member 131, current which has passed through the auxiliary fixed contact 120 and the second terminal 170 is applied to the outside via the second lead switch 153.

In some embodiments of the present disclosure, a first switch unit (not shown) and a second switch unit (not shown), disposed in the conducting member 150 and turned on or off by a magnetic force, may be provided to control a conducted state of the auxiliary relay 100.

The first switch unit and the second switch unit may be configured as various types of switches which are turned on or off by a magnetic force. As the first switch unit and the second switch unit are disposed in the conducting member 150, exposure of the contact parts to the outside is prevented.

A conducted state of the auxiliary relay 100 may be controlled by connecting the first switch unit 160 to the second terminal 170, by connecting the second switch unit to the first terminal 160, and by making the auxiliary fixed contact 120 conducted when one of the first and second switch units is turned on. In this case, the first and second switch units 160, 170 are turned on or off by the magnet member 131 which moves as the movable member 130 moves.

Hereinafter, an 'on/off' operation of the electronic contactor by the auxiliary relay according to some embodiments of the present disclosure will be explained in more detail with reference to FIGS. 5 to 8.

Firstly, if power is supplied to the electronic contactor, a coil is magnetized on the main contact of the electronic contactor, and a fixed core is magnetized. As a result, the movable core moves, and the cross bar including the movable core moves. In this case, the movable member 130 connected to the cross bar also moves.

As shown in FIGS. 7 and 8, as the movable member 130 moves, the magnet member 131 positioned on a side surface of the movable member 130 moves so as to be adjacent to the second lead switch 153 of the conducting member 150. And the second lead switch 153 is turned on by a magnetic force of the magnet member 131.

Once the second lead switch 153 is turned on, the auxiliary relay 100 is in a conducted state by the auxiliary fixed contact 120, the second terminal 170 and the second lead switch 153. As a result, a contact circuit 'a' (which is turned on when power is supplied as a movable contact moves) is connected. In this case, a current flow is indicated by 'D2' of FIG. 8.

If the coil is demagnetized as the power supplied to the electronic contactor is removed, the cross bar moves upward and thus the movable member 130 connected to the cross bar also moves upward. As a result, as shown in FIGS. 5 and 6, the magnet member 131 includes a position change so as to be close to the first lead switch 151.

Once the magnet member 131 is close to the first lead switch 151, the first lead switch 151 is turned on by a magnetic force of the magnet member 131. As a result, the contact circuit 'a' is disconnected, and a contact circuit 'b' (which is turned on when power is not supplied) is connected. In this case, a current flow is indicated by 'D1' of FIG. 6.

With such a configuration, since the first lead switch 151 and the second lead switch 153 are turned on/off in the vacuum tube, the contact parts are not exposed to the outside. This may prevent dust or foreign materials from clinging to the contact parts.

Further, since dust or foreign materials are prevented from clinging to the contact parts, lowering of a conducting performance may be prevented, and thus reliability of the product may be enhanced.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. An auxiliary relay of an electronic contactor, comprising:

a frame;

a movable member configured to move in the frame and including a magnet disposed on one side of the movable member;

a conducting member disposed in the frame and including a first switch unit and a second switch unit, wherein the first and second switch units conduct as the magnet moves;

a first terminal connected to the first switch unit and configured to apply a current when it is determined that the first switch unit is conducting;

a second terminal connected to the second switch unit and configured to apply a current when it is determined that the second switch unit is conducting; and a plurality of guide rails disposed on two sides of the frame and configured to support the conducting member, and a hook disposed in the frame, wherein the hook is configured to contact one surface of the conducting member.

2. The auxiliary relay of an electronic contactor of claim 1, wherein the first switch unit and the second switch unit comprise lead switches.

3. The auxiliary relay of an electronic contactor of claim 2, wherein the conducting member comprises a printed circuit board (PCB).

4. The auxiliary relay of an electronic contactor of claim 1, wherein the first terminal and the second terminal are configured to be inclined with a predetermined angle.

5. The auxiliary relay of an electronic contactor of claim 1, further comprising a magnet inserting unit configured to fixedly-insert the magnet onto a side surface of the movable member.

6. The auxiliary relay of an electronic contactor of claim 5, wherein the magnet inserting unit comprises front and rear surfaces that are open.

* * * * *